United States Patent [19]

Chen

[11] Patent Number: 4,712,253

[45] Date of Patent: Dec. 15, 1987

[54] HUNTING GLOVE WITH TELESCOPIC FOREFINGER SHEATH

[76] Inventor: Yi-Yi Chen, P.O. Box 10160, Taipei, Taiwan

[21] Appl. No.: 945,008

[22] Filed: Dec. 22, 1986

[51] Int. Cl.[4] ..... A41D 19/00

[52] U.S. Cl. ..... 2/159; 2/161 A; 2/163

[58] Field of Search ..... 2/158, 159, 161 A, 163

[56] References Cited

U.S. PATENT DOCUMENTS

| | | | |
|---|---|---|---|
| 474,929 | 5/1892 | Tabor et al. | 2/163 |
| 1,286,771 | 12/1918 | Raymond | 2/159 X |
| 1,786,227 | 12/1930 | Bruggeman | 2/159 |
| 2,253,710 | 8/1941 | Jones et al. | 2/163 |
| 3,608,093 | 9/1971 | Kirby | 2/163 |
| 4,408,358 | 10/1983 | Swan | 2/161 A |
| 4,654,895 | 4/1987 | Peters | 2/161 A |

*Primary Examiner*—Louis K. Rimrodt

[57] ABSTRACT

A hunting glove includes an elastic thick covering formed on a palm piece of a mitten and cut with a U-shaped opening on the covering to form an U-shaped lid normally closing the U-shaped opening, and a soft forefinger sheath formed on a lining of the mitten telescopically protruding through the U-shaped opening for triggering a gun or retracting through the U-shaped opening for concealing the forefinger sheath inside the mitten for cold-weather proof.

3 Claims, 10 Drawing Figures

HUNTING GLOVE WITH TELESCOPIC FOREFINGER SHEATH

BACKGROUND OF THE INVENTION

A conventional mitten as shown in FIG. 1 does not involve a free-operating forefinger sheath and is not suitable for triggering a gun for hunting use. A glove having five separate finger sheaths as shown in FIG. 2 seems to have a foldable forefinger sheath, which however can not be freely operated for triggering a gun since the finger sheath is formed by combining an outer leather and an inner lining which are too thick to be conveniently operated for hunting purpose. The glove as shown in FIG. 3 discloses an opened forefinger sheath adapted for triggering a gun, but can not sustain a user for long-time hunting in a cold freezy weather. The hunting glove as shown in FIG. 4 provides a zipper-closed opening adapted for extending a user's forefinger for triggering a gun. However, such an opening must be opened by the aid of the other hand of the user to thereby cause its operating inconvenience.

U.S. Pat. No. 4,590,626 granted to Chen taught a hunting glove having a forefinger sheath pre-oriented in style suitable for triggering a gun, which is still not so lively for triggering a gun because the forefinger sheath has an appreciated thickness as composed of an outer leather and inner lining.

The present inventor has known the defects of the above-mentioned conventional gloves and invented the present hunting glove with telescopic forefinger sheath.

SUMMARY OF THE INVENTION

The object of the present invention is to provide a hunting glove including a U-shaped lid formed on a palm piece of a mitten and a soft forefinger sheath telescopically protruding or retracting through the U-shaped lid for triggering a hunting gun or for concealing such a forefinger sheath inside the glove, to thereby serve for hunting use in a cold freezy weather.

DETAILED DESCRIPTION

Figure 1:
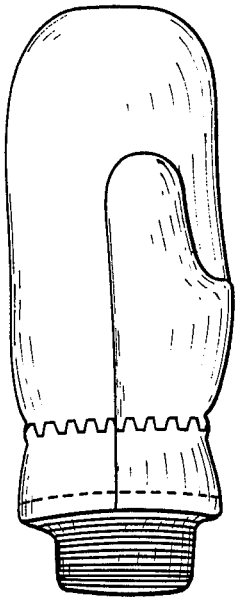
FIG. 1 PRIOR ART
FIG. 1 is an illustration showing a conventional mitten.
Figure 2:
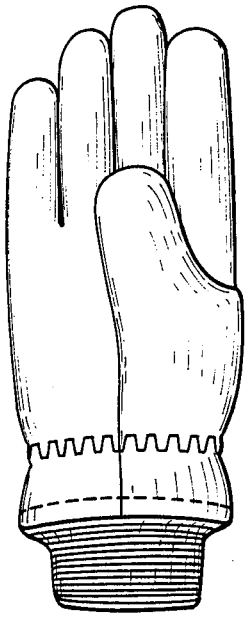
FIG. 2 PRIOR ART
FIG. 2 shows a conventional glove having five separate finger sheaths.
Figure 3:
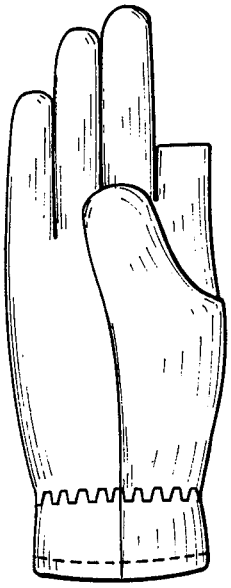
FIG. 3 PRIOR ART
FIG. 3 shows a conventional hunting glove having an opened forefinger sheath.
Figure 4:
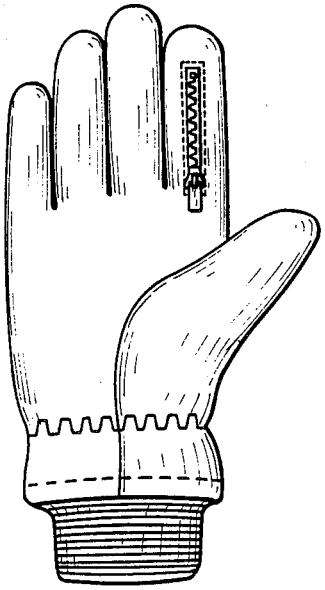
FIG. 4 PRIOR ART
FIG. 4 shows a conventional hunting glove having a zipper-closed opening on a forefinger sheath.
Figure 5:
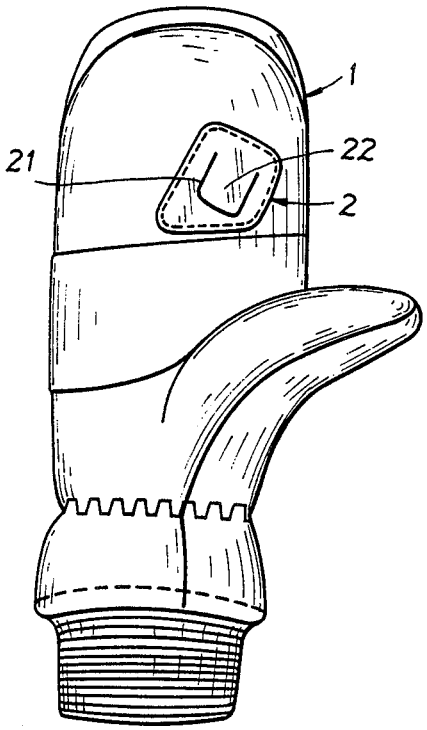
FIG. 5 shows a front elevation of the present invention.
Figure 6:
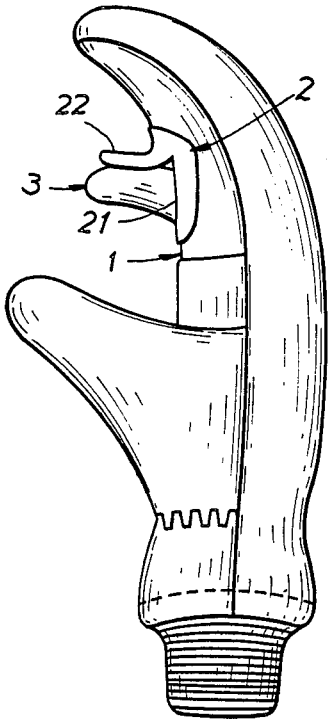
FIG. 6 shows a side view of the present invention when extending a forefinger sheath.
Figure 7:
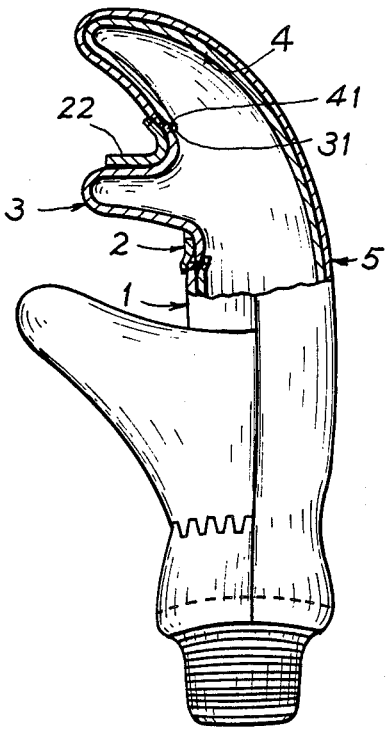
FIG. 7 is a partial sectional drawing of the present invention.
Figure 9:
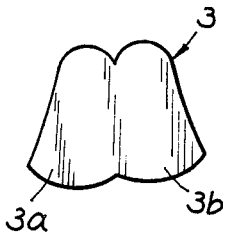
FIG. 9 shows an opened forefinger sheath of the present invention.
Figure 10:
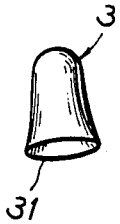
FIG. 10 is a perspective view of the forefinger sheath of the present invention.
Figure 8:
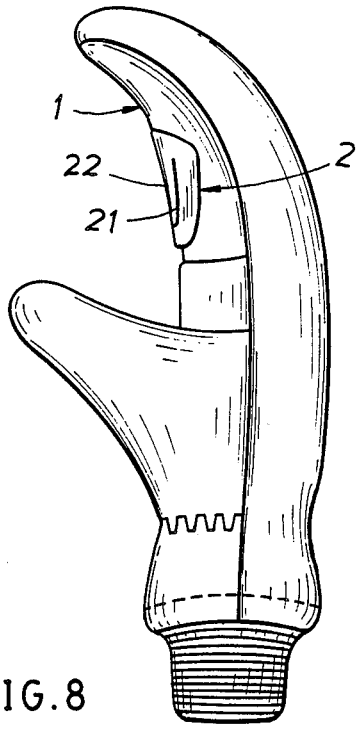
FIG. 8 shows a side view of the present invention when retracting the forefinger sheath inside a glove.

As shown in FIGS. 5–8, the present invention comprises: an elastic thick covering 2 formed on a palm piece 1 of a mitten and having cut an U-shaped opening 21 within the covering 2 to form an U-shaped lid 22 positioned approximately between a finger cushion and a phalanx of a wearer's forefinger when wearing such a mitten, and a soft forefinger sheath 3, formed by combining two leaves 3*a*, 3*b* and having its lower edge 31 fixed on an oval-shaped opening 41 of a lining 4 jacketed inside the palm piece 1 as shown in FIGS. 9, 10, and 7 and a back piece 5 of the mitten. The oval-shaped opening 41 is formed inside the covering 2 of palm piece 1 to correspond with the U-shaped opening 21 of the covering 2, to thereby be adapted for protruding the forefinger sheath 3 through the opening 21 or for rectracting the sheath 3 therethrough.

The elastic thick covering 2 is preferably made of grain leather having sound elasticity and a thickness of about 2.5 mm. Comparatively, the soft forefinger sheath 3 is preferably made of split leather having sound toughness and hand feeling and having a thickness thinner than that of the covering 2 and may be about 1 mm.

When using the present invention for triggering a gun in hunting use, the wearer's forefinger worn in the sheath 3 can be immediately extended outwardly through the opening 21 for quicker triggering operation (FIG. 6). When retracting the forefinger sheath 3 through the opening 21, the U-shape lid 22 can be automatically recovered to close the opening 21 by its self elasticity to prevent cold air penetrating into the interior of the mitten. Accordingly, this invention can serve as an efficient hunting glove for lively triggering a gun in a cold weather, to be superior to the pre-oriented glove as taught by Chen's U.S. Pat. No. 4,590,626.

Naturally, other materials other than leather can be used for making such covering 2 or such sheath 3. The shape of either opening 21 or opening 31 can be modified to be other suitable shapes which are not limited in this invention.

I claim:

1. A hunting glove with telescopic forefinger sheath comprising:

an elastic thick covering formed on a palm piece of a mitten and having cut with an U-shaped opening within said covering to form an U-shaped lid as positioned approximately between a finger cushion and a phalanx of a wearer's forefinger when wearing such a mitten, said thick covering having sound elasticity such that said lid is adapted to be automatically recovered to close said U-shaped opening; and a soft forefinger sheath having a thickness thinner than that of said covering and having a sound toughness and hand feeling and having a lower edge of the forefinger sheath fixed on an oval-shaped opening of a lining jacketed inside the palm piece and a back piece of the mitten, said oval-shaped opening said forefinger sheath being corresponding with said U-shaped opening of said elastic thick covering, and said forefinger sheath adapted to telescopically protrude through said U-shaped opening and said lid of said covering and to retract therethrough to be concealed inside the mitten.

2. A hunting glove according to claim 1, wherein said elastic thick covering is made of grain leather, having a thickness of 2.5 mm.

3. A hunting glove according to claim 1, wherein said soft forefinger sheath is made of split leather, having a thickness of 1 mm.

* * * * *